United States Patent [19]

Moore

[11] 4,229,116

[45] Oct. 21, 1980

[54] LIQUID SOAP DISPENSER AND BRUSH COMBINATION

[76] Inventor: Lee P. Moore, 13315 S. Norfolk, Detroit, Mich. 48235

[21] Appl. No.: 17,367

[22] Filed: Mar. 5, 1979

[51] Int. Cl.[3] ..... A46B 11/04

[52] U.S. Cl. ..... 401/275; 401/280

[58] Field of Search ..... 401/175, 280, 281, 275

[56] References Cited

U.S. PATENT DOCUMENTS

| | | | |
|---|---|---|---|
| 1,003,159 | 9/1911 | Stewart | 401/280 X |
| 1,013,369 | 1/1912 | Bohlig | 401/175 |
| 1,121,788 | 12/1914 | Bongiovanni | 401/281 |
| 1,165,208 | 12/1915 | Ricard | 401/280 X |
| 2,306,482 | 12/1942 | Livingston | 401/275 X |

FOREIGN PATENT DOCUMENTS

| | | | |
|---|---|---|---|
| 322317 | 12/1929 | United Kingdom | 401/275 |

*Primary Examiner*—John D. Yasko

*Attorney, Agent, or Firm*—Charles W. Chandler

[57] ABSTRACT

A combination brush and liquid soap dispenser having a soap container rotatably mounted on the upper end of an arm having a brush on its lower end. The container is rotated in one direction to dispense liquid soap and rotated in the opposite direction to block passage of the soap to the brush.

1 Claim, 5 Drawing Figures

LIQUID SOAP DISPENSER AND BRUSH COMBINATION

BACKGROUND OF THE INVENTION

This invention is related to a combination liquid soap dispenser and cleaning brush and more particularly to such a device in which liquid soap is metered from a handle that functions as a soap container.

There are a variety of hand scrubbing jobs in which the user desires to keep her hands out of scrub water thereby permitting hotter water to be used as well as saving the user's hands from exposure to the irritating action of harsh soaps and detergents. Although long handled brushes are known in the prior art, means for dispensing a liquid soap to a position closely adjacent the brush bristles as they are scrubbing a surface has not been readily commercially available.

SUMMARY OF THE INVENTION

The broad purpose of the present invention is to provide a long armed brush having a container mounted on the arm opposite the brush, with a simple rotary valve disposed in the connection between the container and the arm metering liquid soap to the brush by a simple rotary motion of the container. The preferred embodiment of the invention permits the user to keep her hands out of the scrub water, and enables her to use hotter water, and to have complete control over the application of the liquid soap while brushing the surface to be cleaned, reduces the amount of rinse time, makes the job easier and more convenient and can be manufactured at a relatively low cost.

Still further objects and advantages of the present invention will become readily apparent to those skilled in the art to which the invention pertains upon reference to the following detailed description.

DESCRIPTION OF THE DRAWING

The description refers to the accompanying drawing in which like reference characters refer to like parts throughout the several views and in which.

DESCRIPTION OF THE PREFERRED EMBODIMENT

Figure 1:
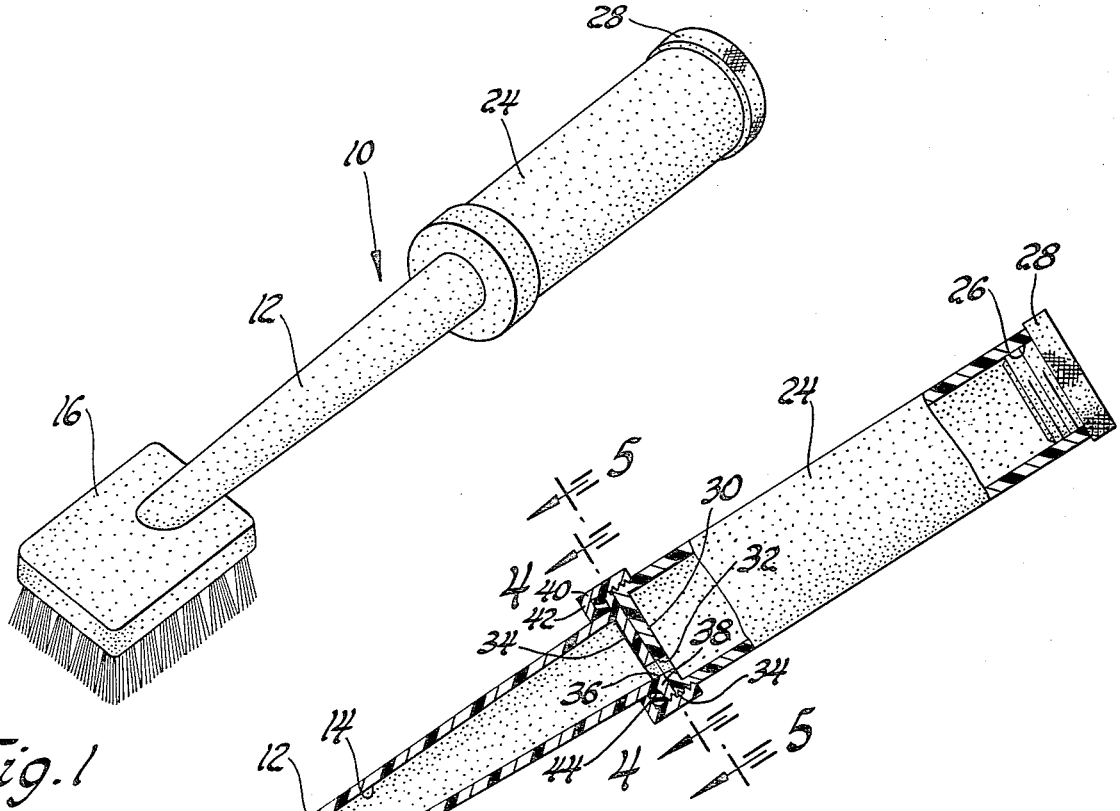
FIG. 1 is a perspective view of a combination liquid soap dispenser and brush combination illustrating the preferred embodiment of the invention.

Referring to the drawing, FIG. 1 illustrates a combination liquid soap and brush dispenser 10 as comprising an elongated tapered arm 12 having an internal passage 14. A body 16, carried on the narrow end of the arm, supports a plurality of bristles 18 which collectively function as a cleaning brush. Body 16 has an internal chamber 20 with openings 22, in communication with passage 14. Openings 22 are appropriately spaced with respect to bristles 18 to provide a uniform coating of a liquid soap received from arm 12, in a manner to be described.

A plastic container 24, adapted to fit within the hand of the user, is mounted on the upper, larger end of arm 12. Container 24 preferably has a tubular structure and is internally threaded at 26. A knurled cap 28 is mounted on the threaded end of the container and is removable to permit the introduction of a liquid soap into the container.

The opposite end of the container has a wall 30 with a valve opening 32. The container is externally threaded at 34 adjacent wall 30.

The larger end of arm 12 has a wall 34 in face-to-face relationship with wall 30. Wall 34 has an opening 36 corresponding to the diameter of opening 32. Wall 34 extends beyond the sidewall of arm 12 to form a shoulder 38.

A collar 40 is carried on arm 12 so as to be movable along the arm to a position permitting the container to be separated from the arm for cleaning the valve openings. Collar 40 has an annular shoulder 42 approximately the same diameter as the large end of the arm, and adapted to be disposed closely adjacent the end of container 24. Collar 40 is threadably mounted on the threaded portion of the container to form a tight slidable engagement between wall 34 and wall 30 An "O" ring 44 is disposed between shoulder 42 and the end of the container to form a liquid-tight seal between the arm and the container.

Figure 2:
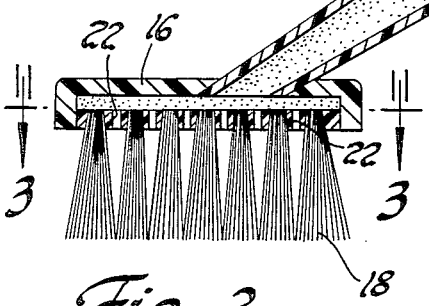
FIG. 2 is a longitudinal sectional view through the combination of FIG. 1.
Figure 3:
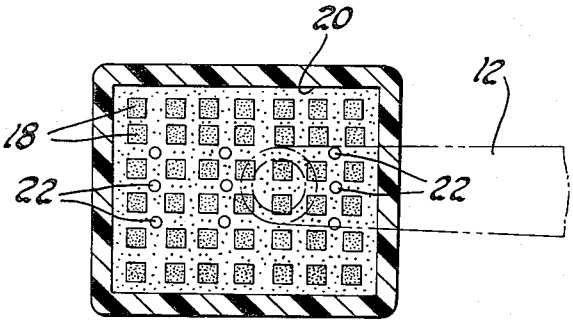
FIG. 3 is an enlarged view taken along lines 3—3 of FIG. 2.
Figure 4:
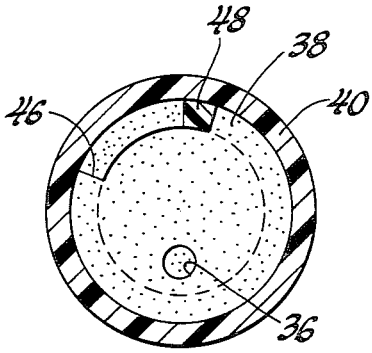
FIG. 4 is an enlarged view taken along lines 4—4 of FIG. 2.
Figure 5:
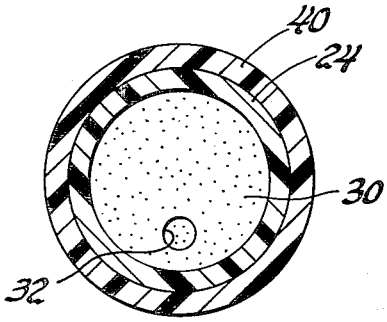
FIG. 5 is a view taken along lines 5—5 of FIG. 1.

Referring to FIGS. 2 and 4, shoulder 38 has an arcuate cut-out portion 46 formed about the axis of rotation of the container with respect to the arm. The end of the container has a finger 48 received in cut-out portion 46. The ends of the cut-out portion define the extreme rotated position of the container with respect to the arm. Preferably the ends of the cut-out portion 46 are formed on about a 90° circumferential angle so that the container can be moved about 90° with respect to the arm between its fully open and closed positions. In the fully open position opening 32 is aligned with the opening 36 to permit passage of a liquid from the container into the internal passage 14 of the arm. In the other rotated position, the walls 34 and 30 block passage of the liquid through the valve openings to the arm.

Having described my invention, I claim:

1. A liquid soap dispenser with brush combination, comprising:

an elongated arm having a longitudinal passage;

a first valve member carried on a first end of said arm so as to be rotatable therewith about an axis of rotation, said first valve member having a fluid opening for receiving liquid soap into said passage, and an arcuate opening disposed about said axis of rotation, said arcuate opening having a first end and a second end;

brush means carried on the opposite end of said arm, said arm having outlet opening means for passing liquid soap from said passage to said brush means;

a container;

a second valve member carried with the container so as to be rotatable therewith, the second valve member having a second fluid opening therein, and being supported in close proximity adjacent the first valve member;

a finger carried on the second valve member and received in the arcuate opening of the first valve member;

a collar carried on the arm and threadably connected to the container such that the container and the arm are relatively movable between a first rotated position defined by said finger engaging the first end of said arcuate opening in which the fluid opening of the second valve member is aligned with the fluid opening of the first valve member to permit passage through both of said fluid openings, and a second rotated position defined by the finger engaging the second end of the arcuate opening in which the fluid opening in the second valve member is blocked by the first valve member; and an O-ring sealingly mounted between said valve members and said collar.

* * * * *